US010408064B2

(12) United States Patent
Zuniga

(10) Patent No.: US 10,408,064 B2
(45) Date of Patent: Sep. 10, 2019

(54) IMPINGEMENT JET STRIKE CHANNEL SYSTEM WITHIN INTERNAL COOLING SYSTEMS

(71) Applicant: Siemens Aktiengesellschaft, München (DE)

(72) Inventor: Humberto A. Zuniga, Casselberry, FL (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 297 days.

(21) Appl. No.: 15/317,982

(22) PCT Filed: Jul. 9, 2014

(86) PCT No.: PCT/US2014/045840
§ 371 (c)(1),
(2) Date: Dec. 12, 2016

(87) PCT Pub. No.: WO2016/007145
PCT Pub. Date: Jan. 14, 2016

(65) Prior Publication Data

US 2018/0258773 A1 Sep. 13, 2018

(51) Int. Cl.

| | |
|---|---|
| ***F01D 5/18*** | (2006.01) |
| ***F01D 25/12*** | (2006.01) |
| ***F28F 13/12*** | (2006.01) |

(52) U.S. Cl.
CPC ..... *F01D 5/187* (2013.01); *F01D 5/186* (2013.01); *F01D 25/12* (2013.01); *F28F 13/12* (2013.01);
(Continued)

(58) Field of Classification Search
CPC ..... F01D 5/187; F01D 5/186; F01D 25/12; F28F 13/12; F28F 2210/02;
(Continued)

(56) References Cited

U.S. PATENT DOCUMENTS 6,575,231 B1 * 6/2003 Wu ..... H01L 23/467 165/121
6,932,571 B2 * 8/2005 Cunha ..... F01D 5/18 416/97 R
(Continued)

FOREIGN PATENT DOCUMENTS

EP 1655453 A1 5/2006
EP 1803897 A2 7/2007
(Continued)

OTHER PUBLICATIONS

PCT International Search Report and Written Opinion dated Sep. 30, 2014 corresponding to PCT Application PCT/US2014/045840filed Jul. 9, 2014. (9 pages).

*Primary Examiner* — Raheena R Malik

(57) ABSTRACT

An internal cooling system (14) including an impingement jet strike channel system (16) for increasing the effectiveness of impingement jets (18) is disclosed. The impingement jet strike channel system (16) may include an impingement jet strike cavity (20) offset from one or more impingement orifices (22). A plurality of impingement jet strike channels (24) may extend radially outward from the impingement jet strike cavity (20) forming a starburst pattern of impingement jet strike channels (24) and may be formed by a plurality of ribs (26) that each separate adjacent impingement jet strike channels (24). The ribs (26) forming the impingement jet strike channels (24) may be split one or more times into multiple channels to increase the number of stagnation points (28, 38, 52) to increase the cooling capacity. The impingement jet strike channel system (16) may be used
(Continued)

within components, such as, but not limited to, gas turbine engines (12), including vane inserts, airfoil leading edge cooling systems, platforms, advanced transitions, acoustic resonators, ring segments and the like.

16 Claims, 9 Drawing Sheets

(52) U.S. Cl.
CPC .... *F05D 2220/32* (2013.01); *F05D 2240/303* (2013.01); *F05D 2250/32* (2013.01); *F05D 2250/711* (2013.01); *F05D 2260/201* (2013.01); *F05D 2260/22141* (2013.01); *F28F 2210/02* (2013.01)

(58) Field of Classification Search
CPC ..... F05D 2220/32; F05D 2240/303; F05D 2250/32; F05D 2250/711; F05D 2260/201; F05D 2260/22141
USPC ..... 165/41
See application file for complete search history.

(56) References Cited

U.S. PATENT DOCUMENTS 7,273,351 B2 * 9/2007 Kopmels ..... F01D 5/186 416/97 R
7,407,365 B2 * 8/2008 Dodd ..... F01D 5/147 415/115
7,520,725 B1 4/2009 Liang
7,665,956 B2 * 2/2010 Mitchell ..... F01D 5/182 415/115
7,753,662 B2 * 7/2010 Lai ..... F04D 13/0606 165/80.4
8,056,615 B2 * 11/2011 Downing ..... F28D 15/0233 165/80.4
8,322,980 B2 * 12/2012 Khanna ..... F04D 25/04 415/177
8,449,254 B2 * 5/2013 Devore ..... B22C 9/04 416/1
8,608,443 B2 12/2013 Lee et al.
2002/0018717 A1 2/2002 Dailey
2002/0080563 A1 * 6/2002 Pence ..... B01F 5/06 361/676
2005/0084370 A1 4/2005 Gross
2005/0214118 A1 9/2005 Dodd
2006/0213642 A1 * 9/2006 Lai ..... F28F 1/12 165/80.3
2008/0279696 A1 11/2008 Liang
2011/0305582 A1 12/2011 Lee et al.
2011/0305583 A1 12/2011 Lee et al.
2012/0006518 A1 1/2012 Lee et al.
2012/0076644 A1 3/2012 Zuniga et al.
2012/0201674 A1 8/2012 Lee et al.
2015/0068703 A1 * 3/2015 de Bock ..... B64D 13/00 165/41
2016/0376896 A1 * 12/2016 Spangler ..... F01D 5/187 415/115

FOREIGN PATENT DOCUMENTS

EP 2374996 A2 10/2011
JP H392504 A 4/1991
JP H6101405 A 4/1994
JP 2005299638 A 10/2005
JP 2009281380 A 12/2009
JP 2010509532 A 3/2010
RU 2028456 C1 2/1995

* cited by examiner

IMPINGEMENT JET STRIKE CHANNEL SYSTEM WITHIN INTERNAL COOLING SYSTEMS

FIELD OF THE INVENTION

This invention is directed generally to cooling systems, and more particularly to cooling system usable within structures exposed to high temperatures, such as, but not limited to cooling system in hollow airfoils of turbine engines.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Internal cooling systems often include a plurality of impingement orifices positioned in a wall. The wall with the impingement orifices is typically positioned in close proximity to another wall surface, whereby the cooling fluid flowing through the impingement orifices form impingement jets that are directed into contact with the wall surface. As such, the impingement jet of cooling fluids impinge on the wall surface, which increases the cooling efficiency of the cooling system.

SUMMARY OF THE INVENTION

An internal cooling system and an impingement jet strike channel system for increasing the effectiveness of impingement jets is disclosed. The impingement jet strike channel system may include an impingement jet strike cavity offset from one or more impingement orifices. A plurality of impingement jet strike channels may extend radially outward from the impingement jet strike cavity forming a starburst pattern of impingement jet strike channels and may be formed by a plurality of ribs that each separate adjacent impingement jet strike channels. The ribs forming the impingement jet strike channels may be split one or more times into multiple channels to increase the number of stagnation points to increase the cooling capacity of the impingement jet strike channel system. The ribs may act as fins, which increases the cooling effectiveness of the impingement jet strike channel system. The plurality of impingement jet strike channels may extend radially outward from the impingement jet strike cavity and may form a starburst pattern of impingement jet strike channels. The impingement jet strike channel system may be used within components, such as, but not limited to, gas turbine engines, including vane inserts, airfoil leading edge cooling systems, platforms, advanced transitions, acoustic resonators, ring segments and the like. In at least one embodiment, the turbine airfoil may be formed from a generally elongated, hollow airfoil having a leading edge, a trailing edge, a pressure side, a suction side, a first end, a second end generally opposite to the first end for supporting the airfoil, and an internal cooling system.

The internal cooling system may include one or more impingement jet strike channel systems. The impingement jet strike channel system may be formed from a relatively small structure, such as a micro structure, for increasing the effectiveness of the impingement jet strike channel system. In the impingement jet strike channel system, the impingement jet strike cavity may be offset from one or more impingement orifices, whereby the impingement jet strike cavity is defined by surfaces on at least three sides and includes an opening facing the impingement orifice. A plurality of impingement jet strike channels may extend radially outward from the impingement jet strike cavity and may be formed by a plurality of ribs that each separate adjacent impingement jet strike channels. One or more of the plurality of impingement jet strike channels may be divided into first sub-jet strike channels extending radially outward of an inlet of the impingement jet strike channel from a stagnation point created in the impingement jet strike channel at an upstream end of a first sub-rib. In at least one embodiment, each of the plurality of impingement jet strike channels may be divided into first sub-jet strike channels extending radially outward of an inlet of the impingement jet strike channel from a stagnation point created in the impingement jet strike channel at an upstream end of a first sub-rib. The first sub-jet strike channels may be narrower in width than the impingement jet strike channels.

One or more of the first sub-jet strike channels may be divided into second sub-jet strike channels extending radially outward of the upstream end of a first sub-rib from a stagnation point created in the first sub-jet strike channel at an upstream end of a second sub-rib. In at least one embodiment, each of the first sub-jet strike channels may be divided into second sub-jet strike channels extending radially outward of the upstream end of a first sub-rib from a stagnation point created in the first sub-jet strike channel at an upstream end of a second sub-rib.

Similarly, one or more of the second sub-jet strike channels may be divided into third sub-jet strike channels extending radially outward of the upstream end of a second sub-rib from a stagnation point created in the second sub-jet strike channel at an upstream end of a third sub-rib. In at least one embodiment, each of the second sub-jet strike channels may be divided into third sub-jet strike channels extending radially outward of the upstream end of a second sub-rib from a stagnation point created in the second sub-jet strike channel at an upstream end of a third sub-rib.

In at least one embodiment, adjacent first sub-jet strike channels may merge together radially outward from the upstream end of the first sub-rib. The merged sub-jet strike channels may exhaust the impingement jet cooling fluids from exhaust outlets and into the internal cooling system.

The plurality of impingement jet strike channels may be defined by surfaces on at least three sides and may include an opening facing the impingement orifice. The plurality of impingement jet strike channels may be formed from a plurality of ribs extending radially outward from a surface forming a portion of the internal cooling system. In another embodiment, the plurality of impingement jet strike channels may be formed by the plurality of impingement jet strike channels positioned within a surface forming a portion of the internal cooling system.

One or more of the plurality of impingement jet strike channels may increase in depth from an outer surface of the ribs to an inner surface of the impingement jet strike channel when moving radially outward from the impingement jet strike cavity. In another embodiment, one or more side surfaces forming at least one of the plurality of impingement jet strike channels may be nonlinear. In at least one embodiment, the side surface may be formed from a plurality of ridges that are each separated from each other via valleys forming a serpentine shaped side surface. Both side surfaces forming an impingement jet strike channel may be nonlinear and formed from a plurality of ridges that are each separated from each other via valleys forming a serpentine shaped side surface.

In another embodiment, one or more of the ribs forming the impingement jet strike channel may have a narrower base than a top, which directs impingement cooling fluids inward toward a surface from which the impingement jet strike channels extend. As such, the cooling capacity of the impingement jet strike channel system increases. The ribs forming the plurality of impingement jet strike channels are petal shaped with pointed upstream and downstream ends connected with convex first and second sides. In other embodiments, the ribs may be sphere-shaped, bell-shaped or have other appropriate shapes.

During use, cooling fluids, such as, but not limited to, air, may be supplied to the internal cooling system. The cooling fluids may pass through one or more impingement orifices. As the cooling fluid passes through the impingement orifice, the impingement orifice forms an impingement jet that strikes an impingement jet strike cavity by passing through the opening. The impingement jet then is diverted about 90 degrees to flow along the surface forming the impingement jet strike cavity. The impingement jet flows into each of the impingement jet strike channels along the inner surface and between the surfaces of the ribs forming the sides of the impingement jet strike channels. Some of the cooling fluids strike an upstream end of the rib, which forms a stagnation point that increases the cooling capacity of the impingement jet strike channel system. The cooling fluids forming the impingement jet continue to flow radially outward in a starburst pattern. The cooling fluids then strike the first sub-rib at the upstream end forming a stagnation point and enter into the first sub-jet strike channels. The stagnation point, likewise, increases the cooling capacity of the impingement jet strike channel system. The cooling fluids forming the impingement jet continue to flow radially outward and are further diffused into the second sub-jet strike channels, the third sub-jet strike channels and the like. The cooling fluids are then exhausted from the impingement jet strike channel system at the radially outer ends of the impingement jet strike channels.

An advantage of the impingement jet strike channel system is that a jet impingement is enhanced by working with the wall jet, which is the flow that moves away from the target center once the jet has impinged and turned to flow along the target wall Another advantage of the impingement jet strike channel system is that with division of a impingement jet strike channel, one or more additional stagnation points may be created, which enhances the cooling capacity of the system. Thus, the numerous stagnation points of the impingement jet strike channel system, such as in one embodiment, 64 stagnation points, greatly enhances the cooling capacity of the system.

Still another advantage of the impingement jet strike channel system is that the impingement jet strike channel and sub-channels are configured to contain impingement jet flow within the channels until being exhausted from the system.

Another advantage of the impingement jet strike channel system is that shape of the impingement jet strike channel and sub-channels are shaped to guide the flow of impingement jet flow toward the downstream stagnation points.

Yet another advantage of the impingement jet strike channel system is that the side surfaces of the ribs forming the impingement jet strike channels may be nonlinear with bumps to increase the turbulence of the impingement jet cooling fluid, thereby increasing the cooling capacity of the impingement jet strike channel system.

Another advantage of the impingement jet strike channel system is that the jet flow channels converge to increase the interaction of the jet impingement with the bumpy walls, which increases the turbulence and cooling efficiency of the system.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
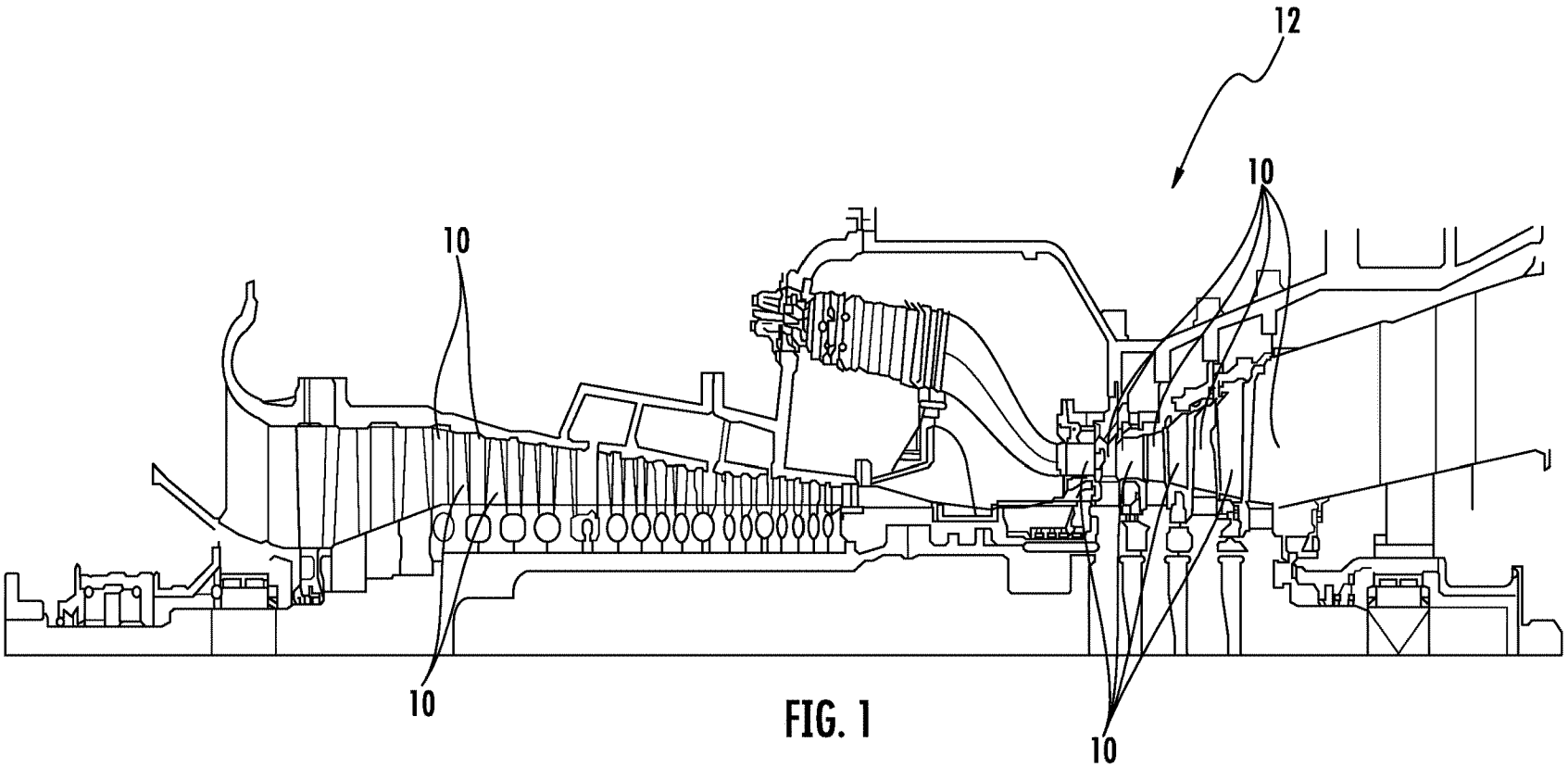
FIG. 1 is a perspective view of a turbine engine having airfoils with the impingement jet strike channel system in an internal cooling system.
Figure 2:
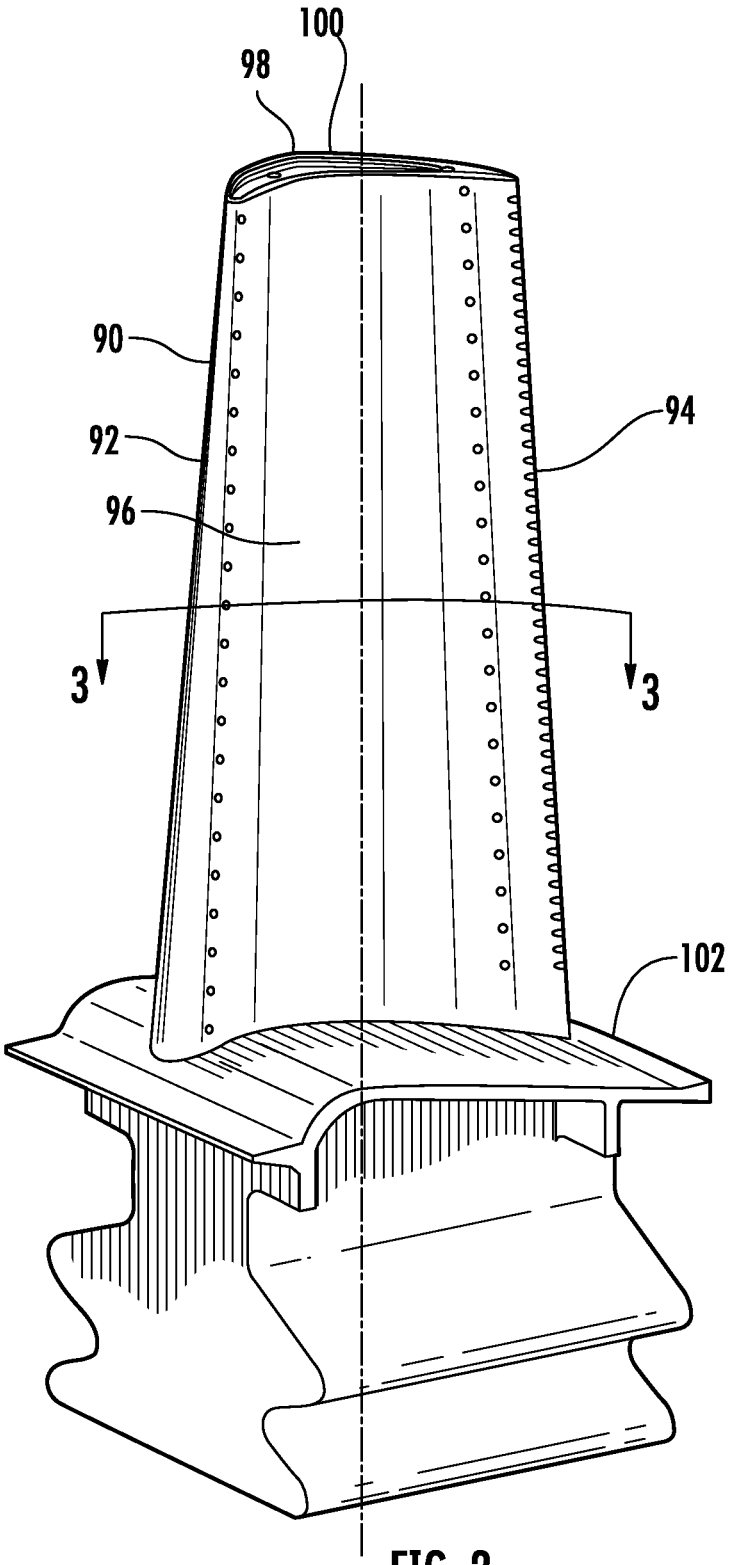
FIG. 2 is a perspective view of a turbine airfoil with the impingement jet strike channel system in an internal cooling system.
Figure 3:
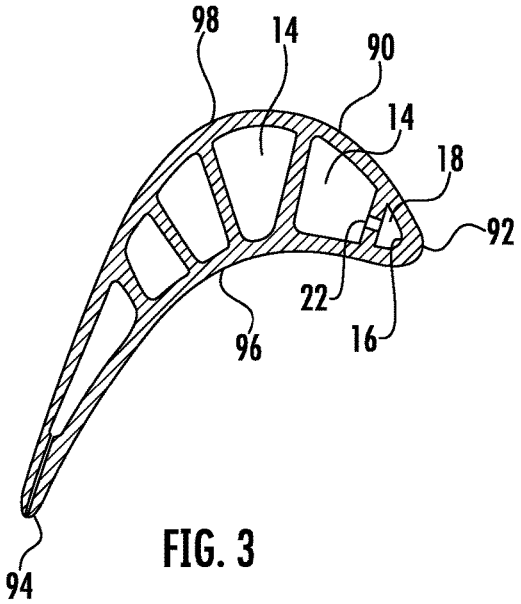
FIG. 3 is a cross-sectional view of the turbine airfoil taken at section line 3-3 in FIG. 2.

As shown in FIGS. 1-18, an impingement jet strike channel system 16 for increasing the effectiveness of impingement jets 18 is disclosed. The impingement jet strike channel system 16 may include an impingement jet strike cavity 20 offset from one or more impingement orifices 22. A plurality of impingement jet strike channels 24 may extend radially outward from the impingement jet strike cavity 20 forming a starburst pattern of impingement jet strike channels 24 and may be formed by a plurality of ribs 26 that each separate adjacent impingement jet strike channels 24. The ribs 26 forming the impingement jet strike channels 24 may be split one or more times into multiple channels 24 to increase the number of stagnation points 28 to increase the cooling capacity of the impingement jet strike channel system 16. The ribs 26 may act as fins, which increases the cooling effectiveness of the impingement jet strike channel system 16. The impingement jet strike channel system 16 may be used within components, such as, but not limited to, gas turbine engines, including vane inserts, airfoil leading edge cooling systems, platforms, advanced transitions, acoustic resonators, ring segments and the like.

In at least one embodiment, a turbine airfoil 10 of a gas turbine engine 12 having an internal cooling system 14 may include the impingement jet strike channel system 16. The turbine airfoil 10 may be formed from a generally elongated, hollow airfoil 90 having a leading edge 92, a trailing edge 94, a pressure side 96, a suction side 98, a first end 100, a second end 102 generally opposite to the first end 100 for supporting the airfoil 90, and the internal cooling system 14.

The impingement jet strike channel system 16 may be positioned within a turbine airfoil 10 having any appropriate shape or configuration and is not limited to being a stationary turbine vane, a rotary turbine blade, a compressor vane or compressor blade.

Figure 4:
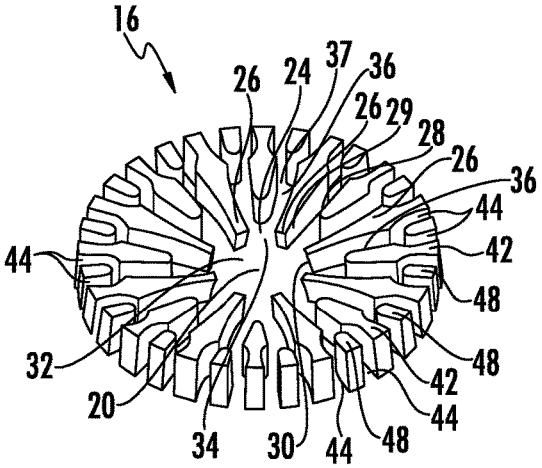
FIG. 4 is a perspective view of an embodiment of the impingement jet strike channel system.
Figure 5:
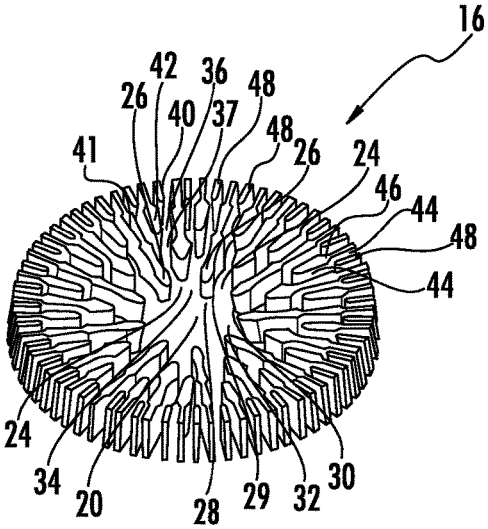
FIG. 5 is a perspective view of another embodiment of the impingement jet strike channel system.
Figure 9:
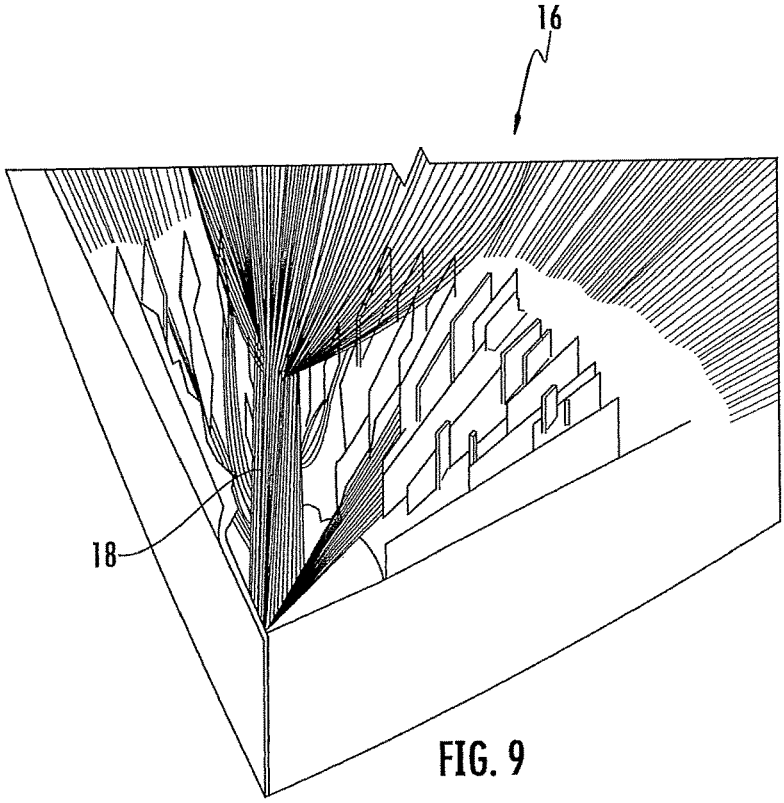
FIG. 9 is a partial perspective view of the impingement jet strike channel system with an impingement jet striking the impingement jet strike cavity.
Figure 10:
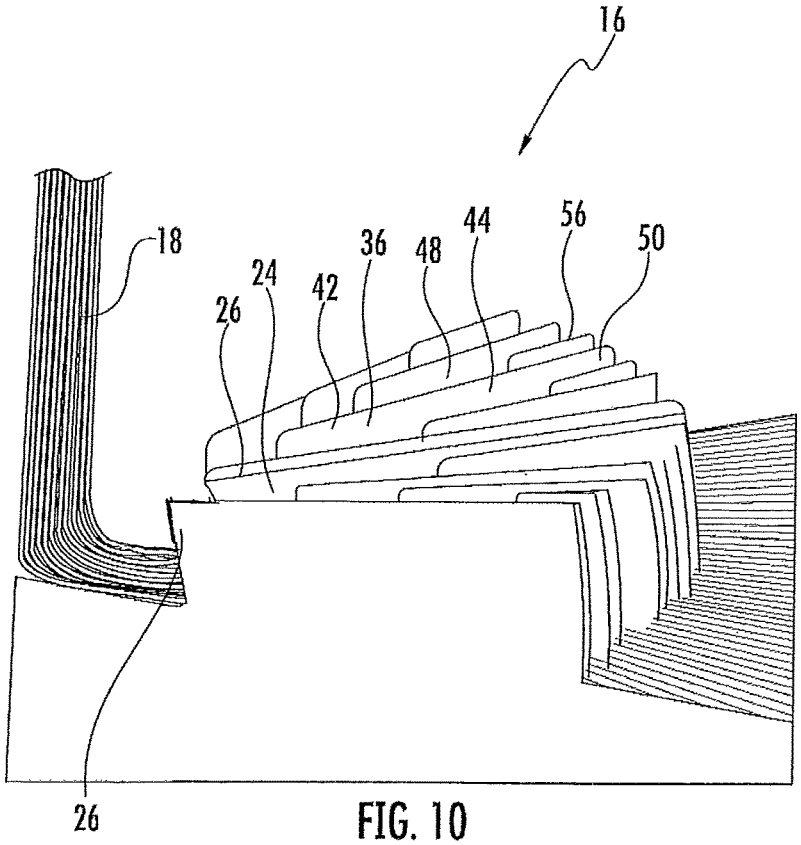
FIG. 10 is another partial perspective view of the impingement jet strike channel system with an impingement jet striking the impingement jet strike cavity.
Figure 11:
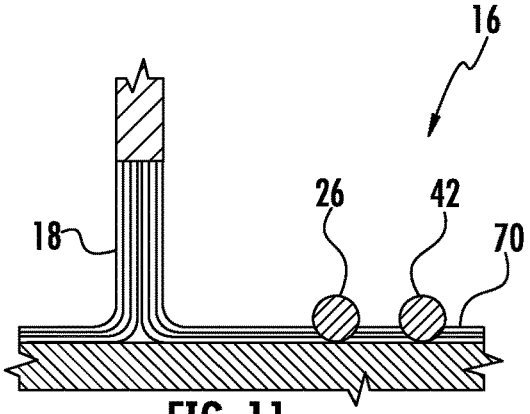
FIG. 11 is a partial side view of impingement jet strike channel system with an impingement jet striking the impingement jet strike cavity and flowing into the impingement jet strike channel, first sub-jet strike channel.
Figure 12:
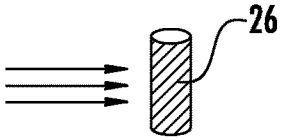
FIG. 12 is a side view of another embodiment of a rib, first sub-rib, second sub-rib, third sub-rib or fourth sub-rib.
Figure 16:
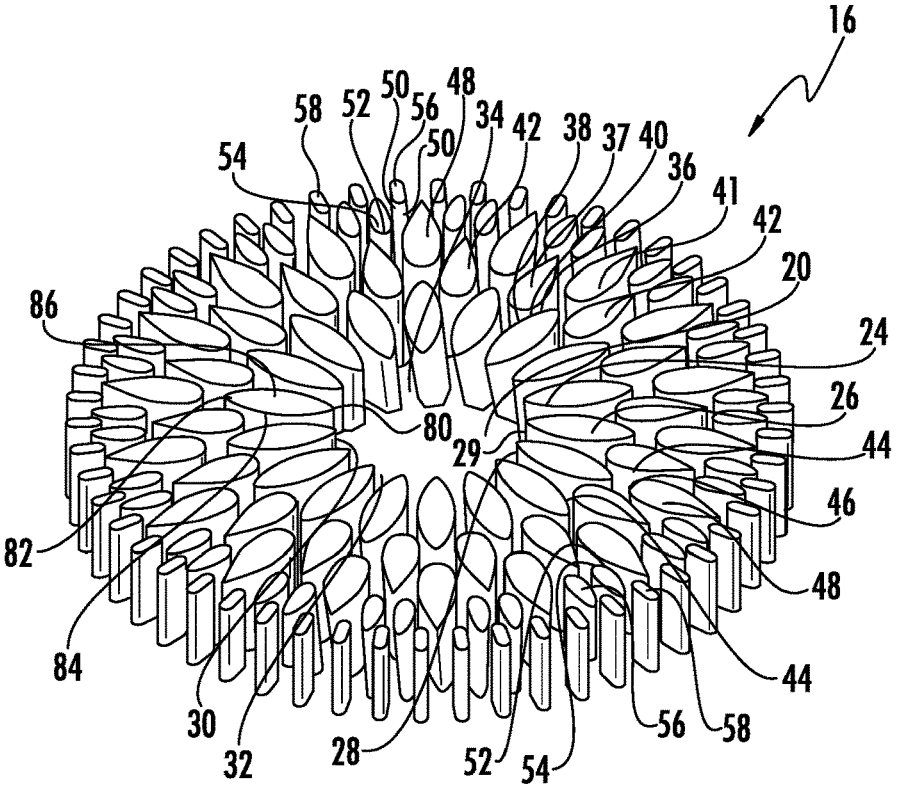
FIG. 16 is a perspective view of another embodiment of the impingement jet strike channel system.
Figure 17:
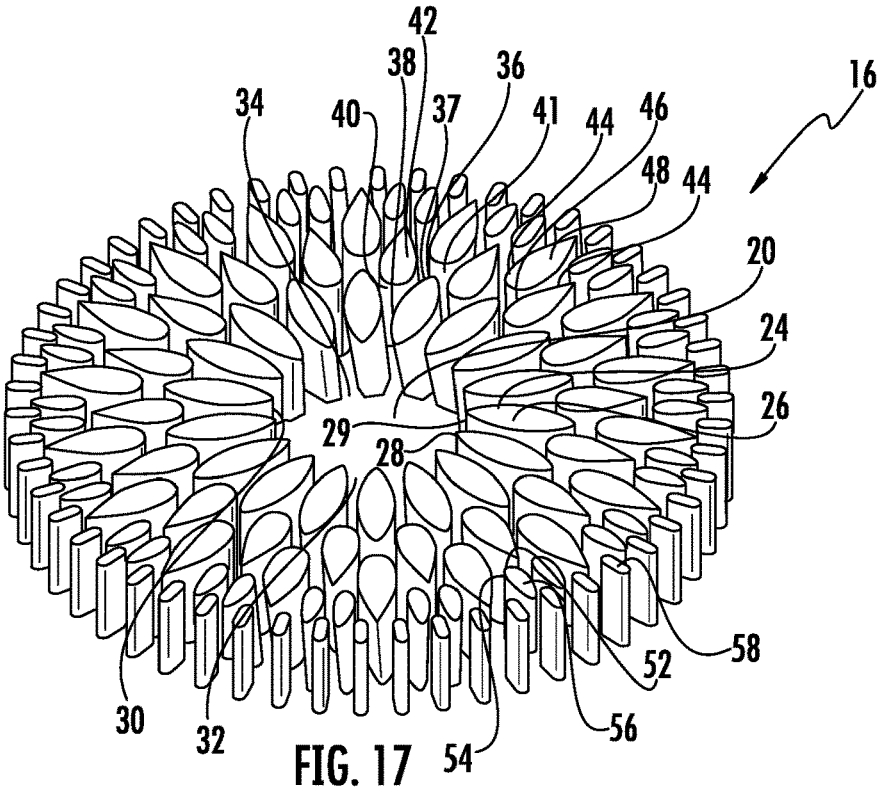
FIG. 17 is a perspective view of another embodiment of the impingement jet strike channel system.

The internal cooling system 14 may include one or more impingement jet strike channel systems 16 formed from an impingement jet strike cavity 20 offset from one or more impingement orifices 22. The impingement jet strike cavity 20 may be defined by surfaces 30 on at least three sides and may include an opening 32 facing the impingement orifice 22. The impingement jet strike cavity 20 may have any appropriate configuration for receiving an impingement jet 18 and deflecting the impingement jet 18 into inlets 34 of the impingement jet strike channels 24. The internal cooling system 14 may also include a plurality of impingement jet strike channels 24 extending radially outward from the impingement jet strike cavity 20 and formed by a plurality of ribs 26 that each separate adjacent impingement jet strike channels 24. The ribs 26 form stagnation points 28 at upstream ends 29 of the ribs 26. The stagnation point 28 at the upstream end 29 of the rib 26 increases heat transfer from the rib 26 to the impingement cooling fluids flowing through the impingement jet strike channels 24. The plurality of impingement jet strike channels 24 may extend radially outward from the impingement jet strike cavity 20 forming a starburst pattern of impingement jet strike channels 24. The plurality of impingement jet strike channels 24 are defined by surfaces 39 on at least three sides and includes an opening 41 facing the impingement orifice 22. In at least one embodiment, the internal cooling system 14 may include eight impingement jet strike channels 24, as shown in FIG. 4, nine impingement jet strike channels 24, as shown in FIGS. 5 and 9, eighteen impingement jet strike channels 24, as shown in FIGS. 16 and 17, or any other number of impingement jet strike channels 24.

The impingement jet strike channels 24 may be divided into multiple cooling sub-channels multiple times to form an ever increasing number of channels moving radially outward away from the impingement jet strike cavity 20. As such, one or more of the plurality of impingement jet strike channels 24 may be divided into first sub-jet strike channels 36 extending radially outward of an inlet 34 of the impingement jet strike channel 24 from a stagnation point 38 created in the impingement jet strike channel 24 at an upstream end 40 of a first sub-rib 42. In at least one embodiment, each of the plurality of impingement jet strike channels 24 is divided into first sub-jet strike channels 36 extending radially outward of an inlet 34 of the impingement jet strike channel 24 from a stagnation point 38 created in the impingement jet strike channel 24 at an upstream end 40 of a first sub-rib 42. The first sub-jet strike channels 36 may be divided into second sub-jet strike channels 44 extending radially outward of the upstream end 40 of a first sub-rib 42 from a stagnation point 38 created in the first sub-jet strike channel 36 at an upstream end 46 of a second sub-rib 48. The second sub-jet strike channels 36 may be divided into third sub-jet strike channels 50 extending radially outward of the upstream end 46 of a second sub-rib 48 from a stagnation point 52 created in the second sub-jet strike channel 44 at an upstream end 54 of a third sub-rib 56.

This pattern may be repeated a number of times. In fact, as shown in FIGS. 16 and 17, the impingement jet strike channel system 16 may include fourth sub-ribs 58 forming an ever increasing number of channels moving radially outward away from the impingement jet strike cavity 20. The pattern of first sub-rib 42, second sub-rib 48, third sub-rib 56 and fourth sub-rib 58 may be repeated for each impingement jet strike channel 24. Each of the impingement jet strike channels 24 may be divided into first sub-jet strike channels 36 extending radially outward of the upstream end 29 of a first sub-rib 42 from a stagnation point 28 created in the impingement jet strike channel 24 at an upstream end 29 of a first sub-rib 42. Each of the first sub-jet strike channels 36 may be divided into second sub-jet strike channels 44 extending radially outward of the upstream end 40 of a first sub-rib 42 from a stagnation point 38 created in the impingement jet strike channel 24 at an upstream end 40 of a first sub-rib 42. Also, each of the second sub-jet strike channels 44 may be divided into third sub-jet strike channels 50 extending radially outward of the upstream end 46 of a second sub-rib 48 from a stagnation point 52 created in the second sub-jet strike channel 44 at an upstream end 54 of a third sub-rib 56.

Figure 6:
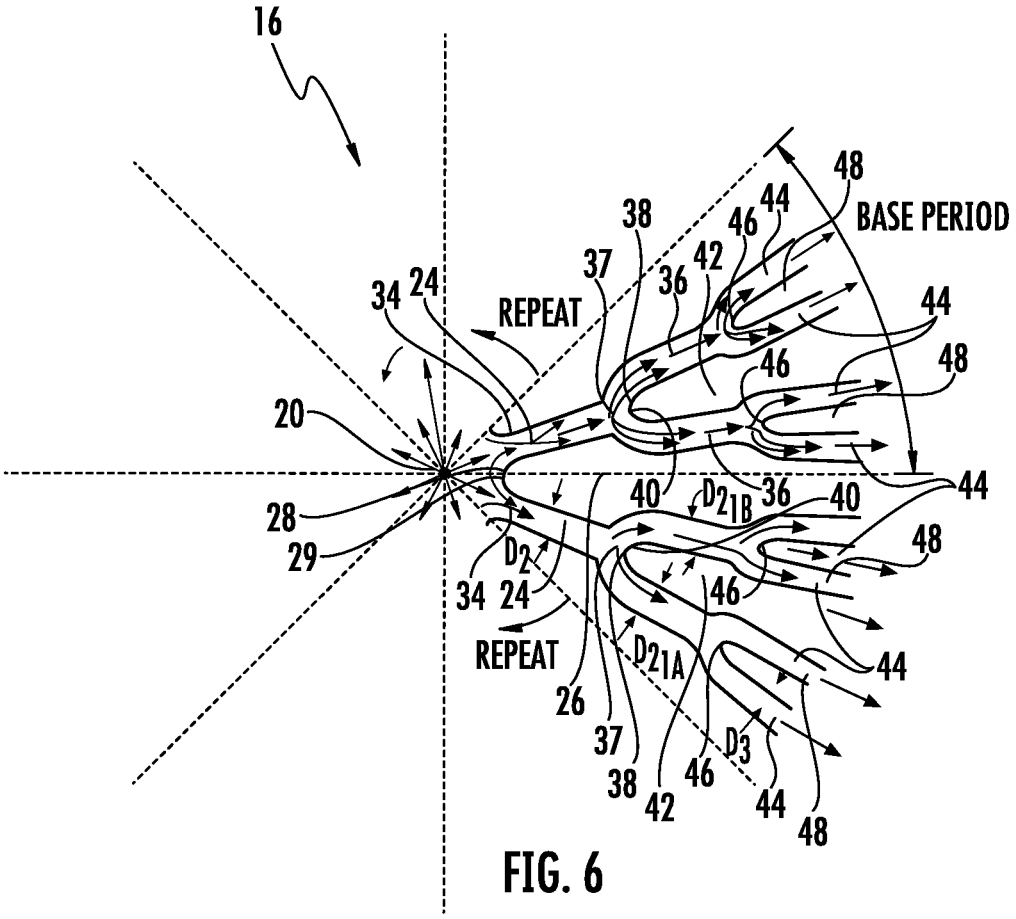
FIG. 6 is a schematic diagram of the impingement jet strike channel, first sub-jet strike channel and second sub-jet strike channel of the impingement jet strike channel system.

In at least one embodiment, as shown in FIG. 6, the first sub-jet strike channels 36 may be narrower in width than the impingement jet strike channels 24. Similarly, the second sub-jet strike channel 44 may be narrower in width than the first sub-jet strike channels 36. The third sub-jet strike channel 50 may be narrower in width than the second sub-jet strike channel 44. In another embodiment, the widths of the first, second and third sub-jet strike channels 36, 44, 50 may relate to each other with fractal relationships, such as coral channels.

Figure 8:
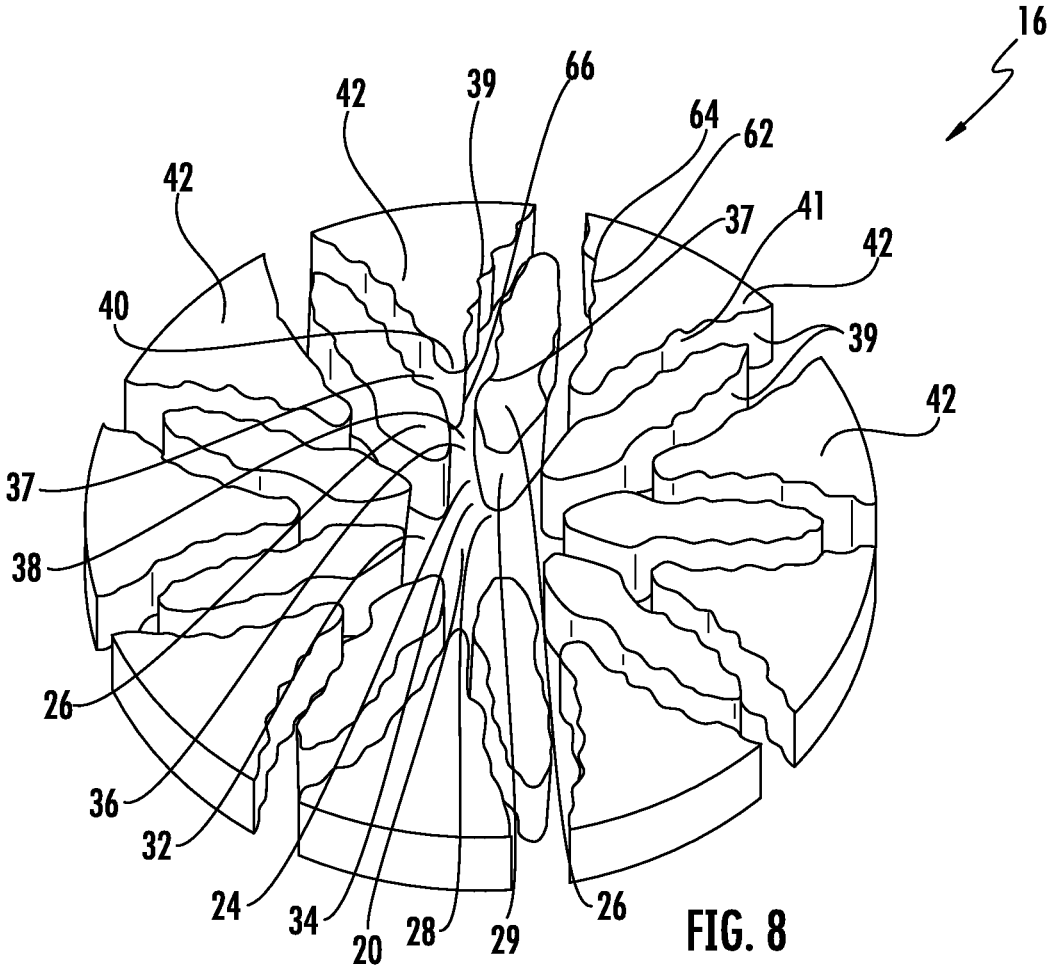
FIG. 8 is a perspective view of another embodiment of the impingement jet strike channel system.

In another embodiment, as shown in FIG. 8, adjacent first sub-jet strike channels 36 may merge together radially outward from the upstream end 40 of the first sub-rib 42. The first sub-rib 42 may have an increasing width moving radially outward. As such, the first sub-rib 42 may be formed from a generally triangular shaped rib, and the rib 26 forming the impingement jet strike channel 24 may be formed from generally elliptical shaped rib. The portion of the rib 26 forming the impingement jet strike channel 24 may have smooth sides. One or more of the side surfaces 39 forming one or more of the plurality of impingement jet strike channels 24, and the first sub-jet strike channel 36 may be nonlinear. One or more of the side surfaces 39 may be formed from a plurality of ridges 62 that may each separated from each other via valleys 64 forming a serpentine shaped side surface 39. As shown in FIG. 8, both side surfaces 39 forming an impingement jet strike channel 24 may be nonlinear and formed from a plurality of ridges 62 that are each separated from each other via valleys 64 forming a serpentine shaped side surface 39. A longitudinal axis 66 of the first sub-jet strike channel 36 may be nonlinear. In particular, the longitudinal axis 66 of the first sub-jet strike channel 36 may be curved such that adjacent first sub-jet strike channels 36 may be coupled together radially outward from an inlet 37 of the first sub-jet strike channels 36. In at least one embodiment, the width of the impingement jet strike channel system 16 may be about 10 millimeters and width of a first sub-jet strike channel 36 being no less than about 395 microns. A height of the first sub-rib 42 may be between one millimeter and two millimeters. An upstream end 40 of the first sub-rib 42 may be about 200 microns in width.

In at least one embodiment, the plurality of impingement jet strike channels 24 may be formed from a plurality of ribs 26 extending radially outward from a surface 30 forming a portion of the internal cooling system 14. The ribs 26 may extend radially outward toward the impingement orifice 22. In another embodiment, the plurality of impingement jet strike channels 24 may be formed by the plurality of impingement jet strike channels 24 being positioned within the surface 30 forming a portion of the internal cooling system 14.

Figure 7:
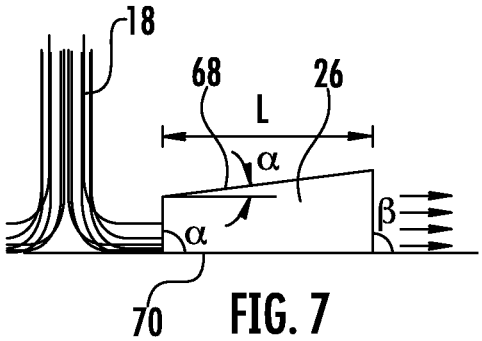
FIG. 7 is a partial side view of a FIG. 4 is a perspective view of an embodiment of a rib forming the impingement jet strike channel of the impingement jet strike channel system.

As shown in FIG. 7, the one or more of the impingement jet strike channels 24 may increase in depth from an outer surface 68 of the ribs 26 to an inner surface 70 of the impingement jet strike channel 24 when moving radially outward from the impingement jet strike cavity 20. Likewise, the first sub-rib 42, the second sub-rib 48, the third sub-rib 56 and fourth sub-rib 58 may also increase in depth from an outer surface 68 of the ribs 26 to an inner surface 70 of the impingement jet strike channel 24 when moving radially outward from the impingement jet strike cavity 20. The outer surfaces 68 of first sub-rib 42, the second sub-rib 48, the third sub-rib 56 and fourth sub-rib 58 may curve radially outward forming a convex surface. In another embodiment, the depth of the impingement jet strike channels 24 may increase by the inner surface 70 of the impingement jet strike channel 24 curving away from the outer surfaces 68 of first sub-rib 42, the second sub-rib 48, the third sub-rib 56 and fourth sub-rib 58, thereby increasing the depth of the impingement jet strike channels 24, the first sub-jet strike channel 36, the second sub-jet strike channel 44, the third sub-jet strike channel 50, and others, if applicable.

Figure 13:
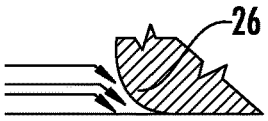
FIG. 13 is a side view of another embodiment of a rib, first sub-rib, second sub-rib, third sub-rib or fourth sub-rib.
Figure 14:
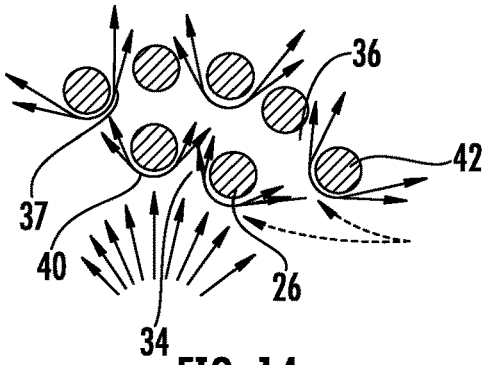
FIG. 14 is a partial top view of another embodiment of the impingement jet strike channel, first sub-jet strike channel and second sub-jet strike channel of the impingement jet strike channel system.
Figure 15:
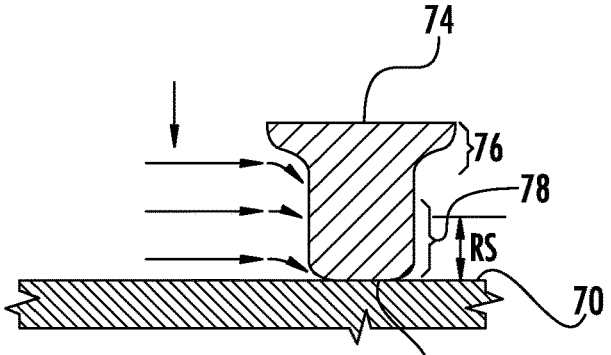
FIG. 15 is a cross-sectional view of another embodiment of the rib, first sub-rib, second sub-rib, third sub-rib or fourth sub-rib.
Figure 18:
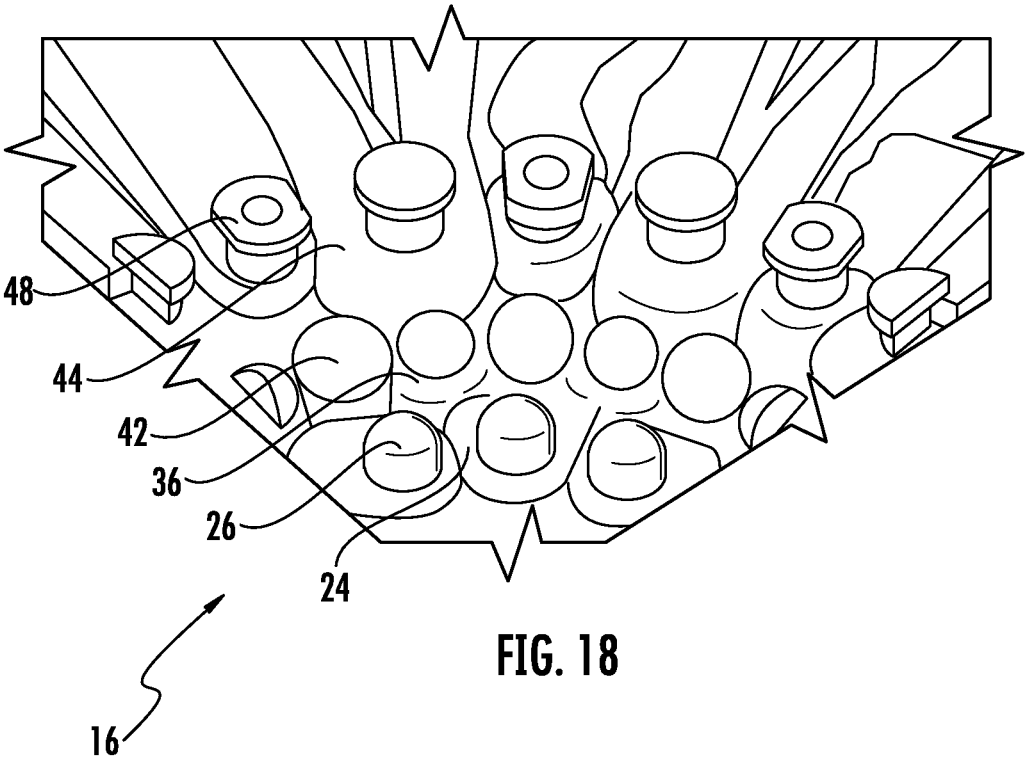
FIG. 18 is a perspective view of another embodiment of the impingement jet strike channel system with spherical ribs and first sub-ribs and bell shaped second sub-ribs.

As shown in FIGS. 13, 15, 18, the one or more of the ribs 26 forming the impingement jet strike channels 24 may have a narrower base 72 than a top 74, which directs impingement cooling fluids inward toward a surface from which the impingement jet strike channels 24 extend. The ribs 26 may have a narrower base 72 on only a single side of the rib 26 forming a side of a single impingement jet strike channel 24. In another embodiment, both sides of the rib 26 may have a narrower base 72 than the top 74 of the rib 26. As shown in FIG. 15, a cross-sectional view of the rib 26 may have a general bell-shaped cross-section, whereby the surfaces 39 forming the sides of the rib 26 are nonlinear, such as curved. The surfaces 39 may include concave and convex curved sections 76, 78. The convex curved section 78 may be positioned outward of the concave section 76 from the inner surface 70 to direct impingement jet cooling fluids towards the inner surface 70 to facilitate increased cooling. One or more of the first sub-rib 42, the second sub-rib 48, the third sub-rib 56 and the fourth sub-rib 58 may have a narrower base 72 than a top 74 and may be configured as set forth for the rib 26. In another embodiment, one or more of the rib 26, first sub-rib 42, the second sub-rib 48, the third sub-rib 56 and the fourth sub-rib 58 may be spherical.

As shown in FIGS. 16 and 17, the ribs 26 forming the plurality of impingement jet strike channels 24 may be petal shaped with pointed upstream and downstream ends 80, 82 connected with convex first and second sides 84, 86. Each of the rib 26 and sub-ribs 42, 48, 56, 58 may be smaller moving radially outward from the impingement strike cavity 20 than the rib 26 or sub-ribs 42, 48, 56, 58 immediately radially inward. In particular, the first sub-rib 42 may be smaller in width or length, or both, than the rib 26. The second sub-rib 48 may be smaller in width or length, or both, than the first sub-rib 42. The third sub-rib 56 may be smaller in width or length, or both, than the second sub-rib 48. The fourth sub-rib 58 may be smaller in width or length, or both, than the third sub-rib 56.

During use, cooling fluids, such as, but not limited to, air, may be supplied to the internal cooling system 14. The cooling fluids may pass through one or more impingement orifices 22. As the cooling fluid passes through the impingement orifice 22, the impingement orifice 22 forms an impingement jet 18 that strikes an impingement jet strike cavity 20 by passing through the opening 32. The impingement jet 18 then is diverted about 90 degrees to flow along the surface 30 forming the impingement jet strike cavity 20. The impingement jet 18 flows into each of the impingement jet strike channels 24 along the inner surface 70 and between the surfaces 39 of the ribs 26 forming the sides of the impingement jet strike channels 24. Some of the cooling fluids strike an upstream end 29 of the rib 26, which forms a stagnation point 28 that increases the cooling capacity of the impingement jet strike channel system 16. The cooling fluids forming the impingement jet 18 continue to flow radially outward in a starburst pattern. The cooling fluids then strike the first sub-rib 42 at the upstream end 40 forming a stagnation point 38 and enter into the first sub-jet strike channels 36. The stagnation point 38, likewise, increases the cooling capacity of the impingement jet strike channel system 16. The cooling fluids forming the impingement jet 18 continue to flow radially outward and are further diffused into the second sub-jet strike channels 44, the third sub-jet strike channels 50 and the like. The cooling fluids are then exhausted from the impingement jet strike channel system 16 at the radially outer ends of the impingement jet strike channels 24.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. An internal cooling system comprising:

at least one impingement jet strike channel system, comprising;

an impingement jet strike cavity offset from at least one impingement orifice, wherein the impingement jet strike cavity is defined by surfaces on at least three sides and includes an opening facing the at least one impingement orifice;

a plurality of impingement jet strike channels extending radially outward from the impingement jet strike cavity and formed by a plurality of ribs that each separate adjacent impingement jet strike channels; and wherein at least one of the plurality of impingement jet strike channels is divided into first sub-jet strike channels extending radially outward of an inlet of the impingement jet strike channel from a stagnation point created in the impingement jet strike channel at an upstream end of a first sub-rib, wherein at least one of the plurality of impingement jet strike channels increases in depth from an outer surface of the ribs to an inner surface of impingement jet strike channel when moving radially outward from the impingement jet strike cavity.

2. The internal cooling system of claim 1, wherein each of the plurality of impingement jet strike channels is divided into first sub-jet strike channels extending radially outward of an inlet of the impingement jet strike channel from a stagnation point created in the impingement jet strike channel at an upstream end of a first sub-rib.

3. The internal cooling system of claim 2, wherein the first sub-jet strike channels are narrower in width than the impingement jet strike channels.

4. The internal cooling system of claim 2, wherein at least one of the first sub-jet strike channels is divided into second sub-jet strike channels extending radially outward of the upstream end of a first sub-rib from a stagnation point created in the first sub-jet strike channel at an upstream end of a second sub-rib.

5. The internal cooling system of claim 4, wherein at least one of the second sub-jet strike channels is divided into third sub-jet strike channels extending radially outward of the upstream end of a second sub-rib from a stagnation point created in the second sub-jet strike channel at an upstream end of a third sub-rib.

6. The internal cooling system of claim 1, wherein each of the first sub-jet strike channels is divided into second sub-jet strike channels extending radially outward of the upstream end of a first sub-rib from a stagnation point created in the first sub-jet strike channel at an upstream end of a second sub-rib.

7. The internal cooling system of claim 6, wherein each of the second sub-jet strike channels is divided into third sub-jet strike channels extending radially outward of the upstream end of a second sub-rib from a stagnation point created in the second sub-jet strike channel at an upstream end of a third sub-rib.

8. The internal cooling system of claim 1, wherein adjacent first sub-jet strike channels merge together radially outward from the upstream end of the first sub-rib.

9. The internal cooling system of claim 1, wherein the plurality of impingement jet strike channels are defined by surfaces on at least three sides and includes an opening facing the at least one impingement orifice.

10. The internal cooling system of claim 1, wherein the plurality of impingement jet strike channels extending radially outward from the impingement jet strike cavity forms a starburst pattern of impingement jet strike channels.

11. The internal cooling system of claim 1, wherein the plurality of impingement jet strike channels are formed from a plurality of ribs extending radially outward from a surface forming a portion of the internal cooling system.

12. The internal cooling system of claim 1, wherein the plurality of impingement jet strike channels are formed by the plurality of impingement jet strike channels being positioned within a surface forming a portion of the internal cooling system.

13. The internal cooling system of claim 1, wherein at least one side surface forming at least one of the plurality of impingement jet strike channels is non-linear.

14. The internal cooling system of claim 1, wherein at least one of the ribs forming the impingement jet strike channels has a narrower base than a top, which directs impingement cooling fluids inward toward a surface from which the impingement jet strike channels extend.

15. The internal cooling system of claim 1, wherein the ribs forming the plurality of impingement jet strike channels are petal shaped with pointed upstream and downstream ends connected with convex first and second sides.

16. The internal cooling system of claim 13, wherein the at least one side surface includes a concave section and a convex section, the convex section being positioned outward of the concave section from an inner surface of the impingement jet strike channel.

* * * * *